US005179973A

United States Patent [19]

Dickson et al.

[11] Patent Number: 5,179,973

[45] Date of Patent: Jan. 19, 1993

[54] VALVE WITH PRESSURE ASSISTED CLOSING SYSTEM

[75] Inventors: Rennie L. Dickson, Carrollton; Craig W. Godfrey, Richardson; Kenneth L. Schwendemann, Lewisville; Timothy J. Noack, Grapevine, all of Tex.

[73] Assignee: Otis Engineering Corp., Dallas, Tex.

[21] Appl. No.: 718,568

[22] Filed: Jun. 20, 1991

Related U.S. Application Data

[62] Division of Ser. No. 310,697, Feb. 15, 1989, Pat. No. 5,050,839.

[51] Int. Cl.[5] ..... F16K 31/22; F16K 31/122

[52] U.S. Cl. ..... 137/433; 166/321; 166/324; 251/58; 251/63.6; 251/315

[58] Field of Search ..... 166/321, 324, 325, 319; 251/58, 63.6, 315; 137/433; 60/413, 417

[56] References Cited

U.S. PATENT DOCUMENTS

| | | | |
|---|---|---|---|
| 3,782,461 | 1/1974 | Watkins | 166/72 |
| 3,826,462 | 7/1974 | Taylor | 251/58 |
| 3,860,069 | 1/1975 | Wray et al. | 166/321 |
| 3,964,544 | 6/1976 | Farley et al. | 166/321 |
| 3,993,136 | 11/1976 | Mott | 137/461 |
| 4,014,386 | 3/1977 | Johnson et al. | 166/321 |
| 4,044,835 | 8/1977 | Mott | 251/58 |
| 4,105,075 | 8/1978 | Helmus | 166/321 |
| 4,252,197 | 2/1981 | Pringle | 166/324 |
| 4,361,188 | 11/1982 | Russell | 166/321 |
| 4,373,587 | 2/1983 | Pringle | 166/324 |
| 4,467,867 | 8/1984 | Baker | 166/321 |
| 4,494,609 | 1/1985 | Schwendemann | 166/322 |
| 4,569,398 | 2/1986 | Pringle | 166/321 |
| 4,617,999 | 10/1986 | Beck | 166/321 |
| 4,976,317 | 12/1990 | Leismer | 166/321 |

FOREIGN PATENT DOCUMENTS 0204619 12/1986 European Pat. Off. .

*Primary Examiner*—George L. Walton
*Attorney, Agent, or Firm*—M. H. Gay

[57] ABSTRACT

A valve employing a coupling disk to rotate the valve member so that rotative force is applied to the valve member in a direction away from the seat during opening of the valve and/or in a direction toward the seat during closing of the valve. Closing force is provided by a spring in a dome chamber and a gas charge in the dome chamber. A float valve controls fluid entry into the dome chamber to trap the gas charge therein while permitting the introduction of liquid from a balance-closure assist line to increase the pressure of the gas charge and assist in closing the valve member.

9 Claims, 7 Drawing Sheets

FIG. 7
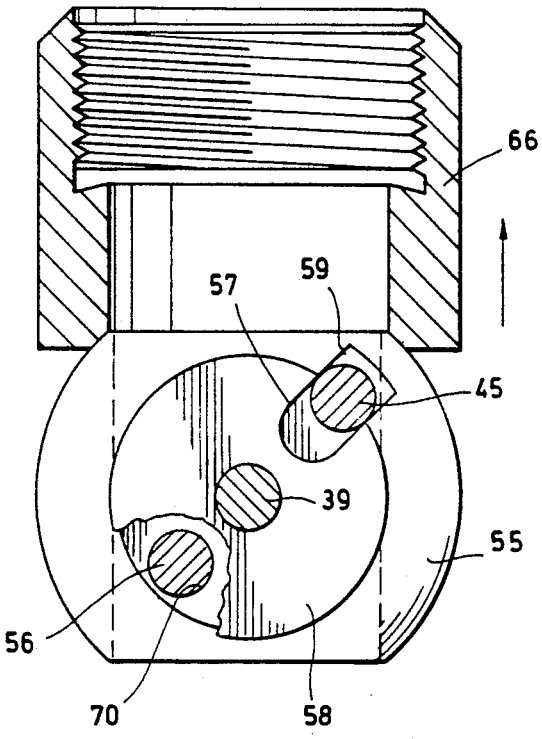
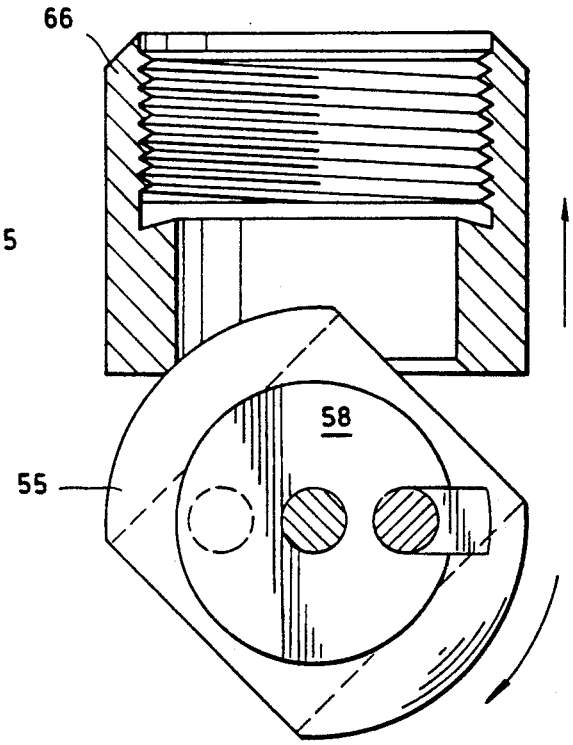
FIG. 8
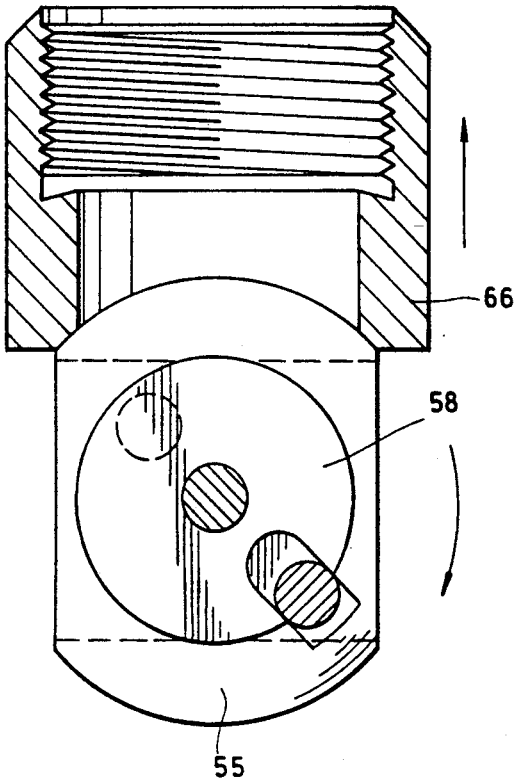
FIG. 9

FIG. 11
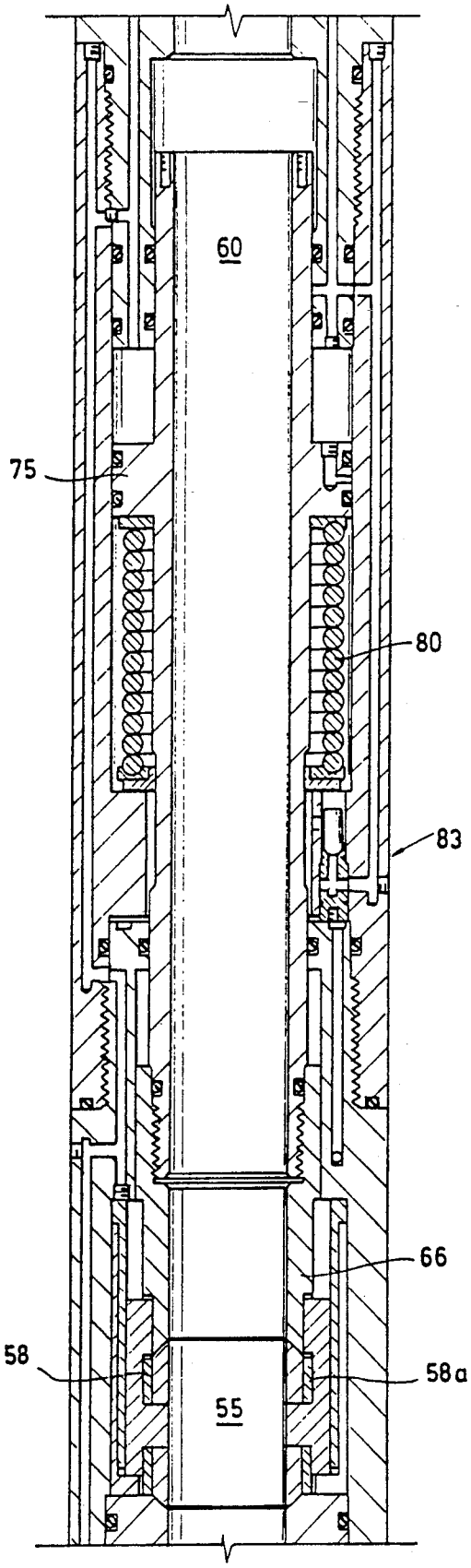
FIG. 12
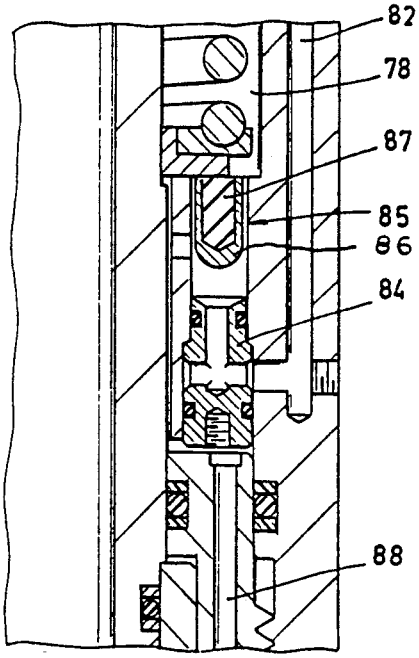
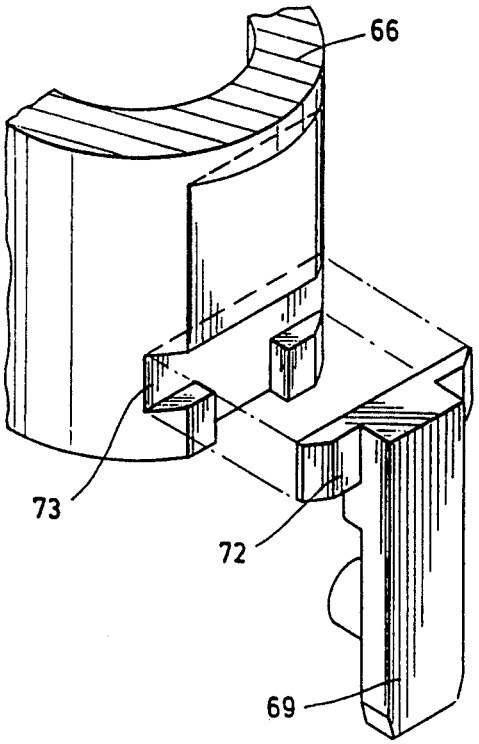
FIG. 13

VALVE WITH PRESSURE ASSISTED CLOSING SYSTEM

This application is a division of application Ser. No. 07/310,697, filed Feb. 15, 1989 now U.S. Pat. No. 5,050,839, issued Sept. 24, 1991.

This invention relates to valves. While not limited in application the invention is particularly useful in valves used in test trees and in subsurface safety valves.

In the use of subsurface test trees, a wire line or tubing may be present in the test tree and obstruct closing of the valve. Ball valves are common in these circumstances and on closing sever the wire line or reeled tubing. To provide a force to close the ball valve member, it has been proposed that a gas charge in a pressure dome exert a closing force and that pressure from a balance or closing assist line urge the valve towards closed position. See U.S. Pat. No. 4,494,609. Flopetrol Johnston has offered for sale a valve which like the above identified U.S. patent utilizes pressure from a balance line to assist in closing a valve in combination with a pressure dome also exerting pressure to close the valve.

In closing a valve which must cut a wire line or tubing during the closing action, the valve member in presently available valves tends to be urged away from its seat and to smear the wire line or tubing during the cutting action as the forces tend to separate the valve member from the seat.

Once closed, downhole valves are normally subjected to a substantial differential as they are exposed to formation pressure below and to a much lower surface pressure above. Rotating a ball valve against a differential tends to result in galling as the ball valve member is held against its seat by the pressure differential across the valve.

It is an object of this invention to provide a valve having a ball valve member in which the valve member is urged away from its seat during rotation from closed to open position.

Another object is to provide a valve having a ball valve member which is urged toward its seat during closing.

Another object is to provide a valve having a ball valve member in which a disk is rotatable about the same axis as the ball valve member and applies force to the ball valve member through a couple which urges the ball valve member away from its seat during opening action.

Another object is to provide a valve having a ball valve member in which a disk is rotatable about the same axis as the ball valve member and applies force to the ball valve member through a couple which urges the ball valve member toward its seat during closing action.

Another object is to provide a valve having a traveling seat and a ball valve member with a disk rotatable coaxially with the ball valve member and to apply opening force to the ball valve member through a couple provided by the disk.

Another object is to provide a valve having a traveling seat and a ball valve member with a disk rotatable coaxially with the ball valve member and to apply a closing force to the ball valve member through a couple provided by the disk.

Another object is to provide a valve with closing action assisted by pressure within a pressure dome in pressure within the dome may be increased from an exterior source.

Another object is to provide a valve which utilizes a pressure dome to assist in closing the valve which dome is exposed to hydrostatic pressure in a balance line and in which liquid from the balance line may be introduced into the dome chamber through a float valve to increase the dome pressure and assist in closing the valve and in which the float valve traps the gas charge in the dome chamber.

Another object is to simplify the design of a valve in which pressure assist closing force from a balance line augments a pressure dome urging the valve towards closed position by combining the pressure dome and balance linepressure assist chamber in one chamber.

Another object is to provide a ball type valve in which frictional resistance to moving the ball member to open position is reduced.

Another object is to provide a valve with a ball type valve member in which during closing the ball valve member is urged towards its seat to aid in cutting through a tubing or wire line extending through the valve.

Another object is to provide a valve with a ball type valve member in which the mechanical force rotating the valve member urges the valve member away from its seat.

Another object is to provide a valve with a ball type valve member in which the mechanical force rotating the ball valve urges the valve member toward its seat.

Another object is to increase the bearing area available for engagement by a fixed boss to rotate the ball valve member of a valve.

Another object, features and advantages of this invention will be apparent from the drawings, specification and the claims.

In the drawings wherein illustrative embodiments of this invention are shown:

FIG. 7 is a view similar to FIG. 4 of a slightly modified form of this invention in which the valve is moving toward a closed position and forces are being applied to urge the ball valve member against its seat;

FIG. 8 is a view similar to FIG. 7 showing the ball valve member to have been partially rotated to the closed position;

FIG. 9 is a view similar to FIG. 7 showing the ball valve member to have been fully rotated to the closed position;

FIG. 11 is a fragmentary sectional view of the valve of FIG. 10 showing the valve in open position;

FIG. 12 is a sectional view on an enlarged scale of a fragment of the valve of FIG. 11; and FIG. 13 is a isometric exploded view of a fragment of the valve seat and a control arm of the valve of FIG. 10.

Figure 10:
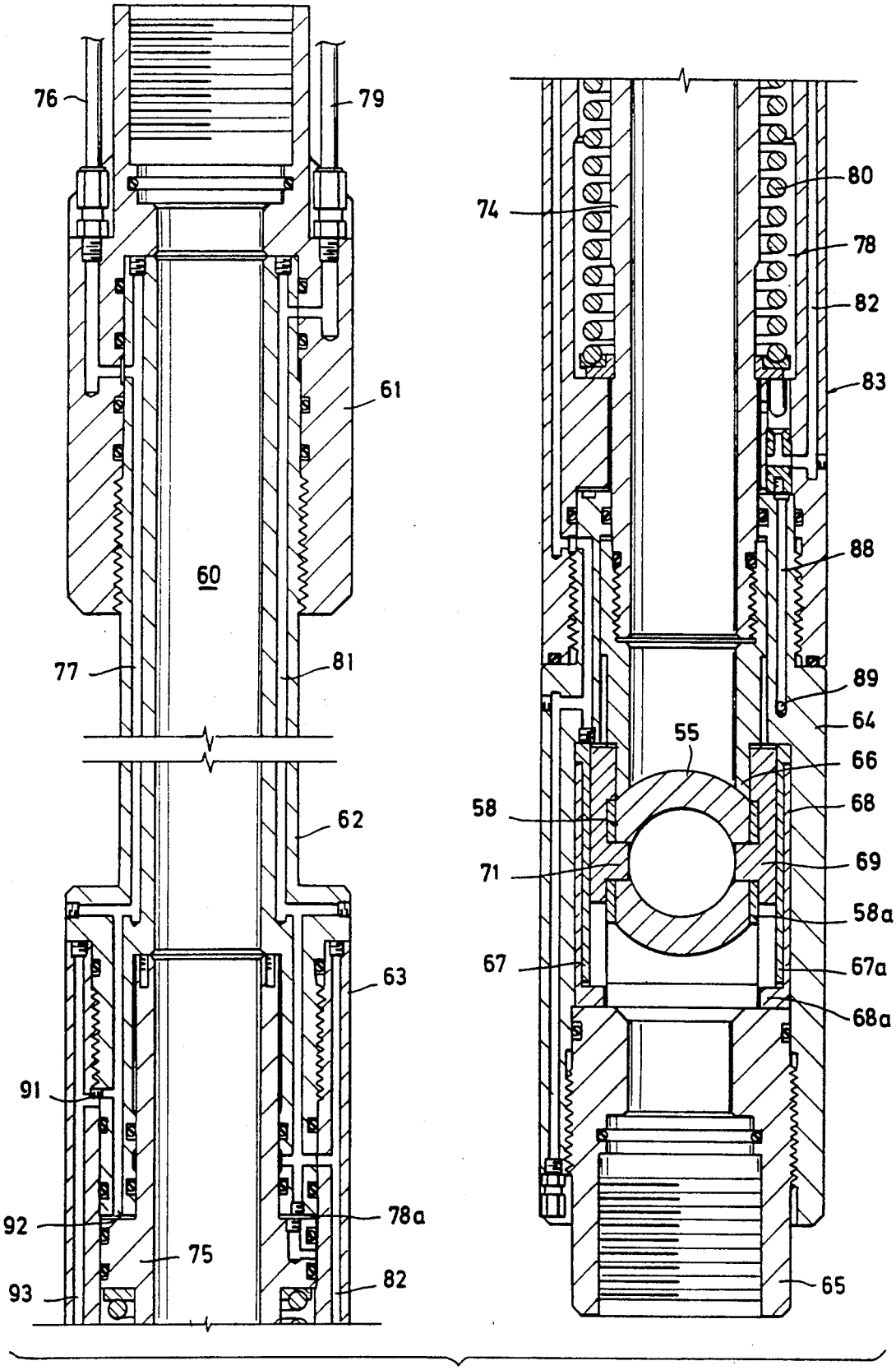
FIG. 10 is a view in section through a modified form of this invention showing the valve in closed position.

The valve of this invention may be used in any situation in which is desired to use a ball valve member and to urge the ball valve member away from its seat during opening operations to reduce the possibility of galling and/or to urge the valve member towards its seat during closing for any desired purpose such as severing equipment passing through the valve such as tubing or a wire line. Further the valve may be used in any circumstance in which large bearing areas are desired or additional force is desirably applied during the closing movement such as to cut through tubing or a wire line For instance, the valve illustrated in FIG. 1 and 2 is a subsurface safety valve in which the design is directed toward reducing the possibility of galling between the seat and valve member while the valve of FIG. 10 and 11 is primarily directed toward a design usable in a test tree in which the valve member is primarily urged toward its seat during rotation so that it can readily cut any wire line or tubing extending through the valve in moving to the closed position.

Figure 1:
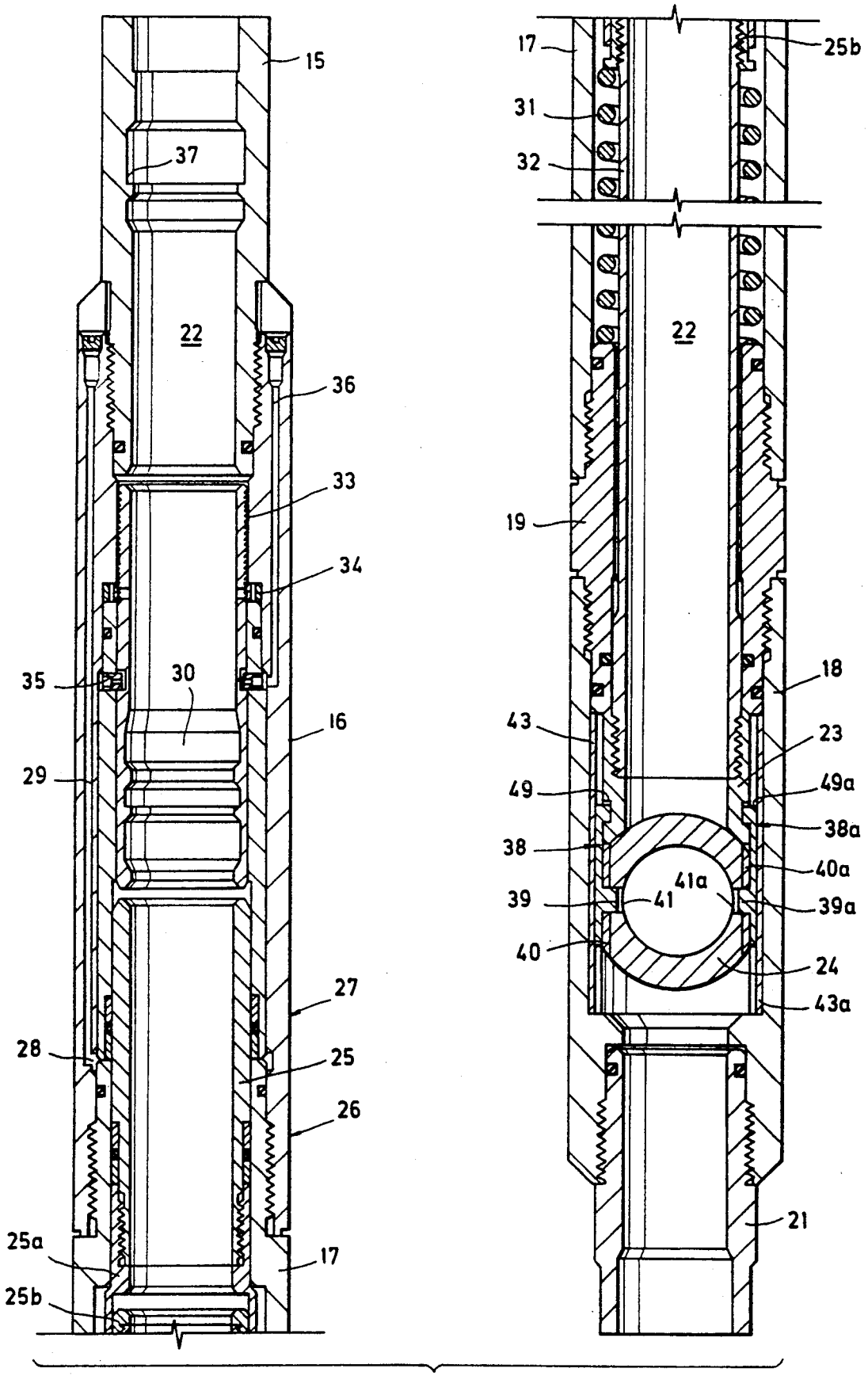
FIG. 1 is a sectional view through one form of this invention showing the valve in closed position.
Figure 2:
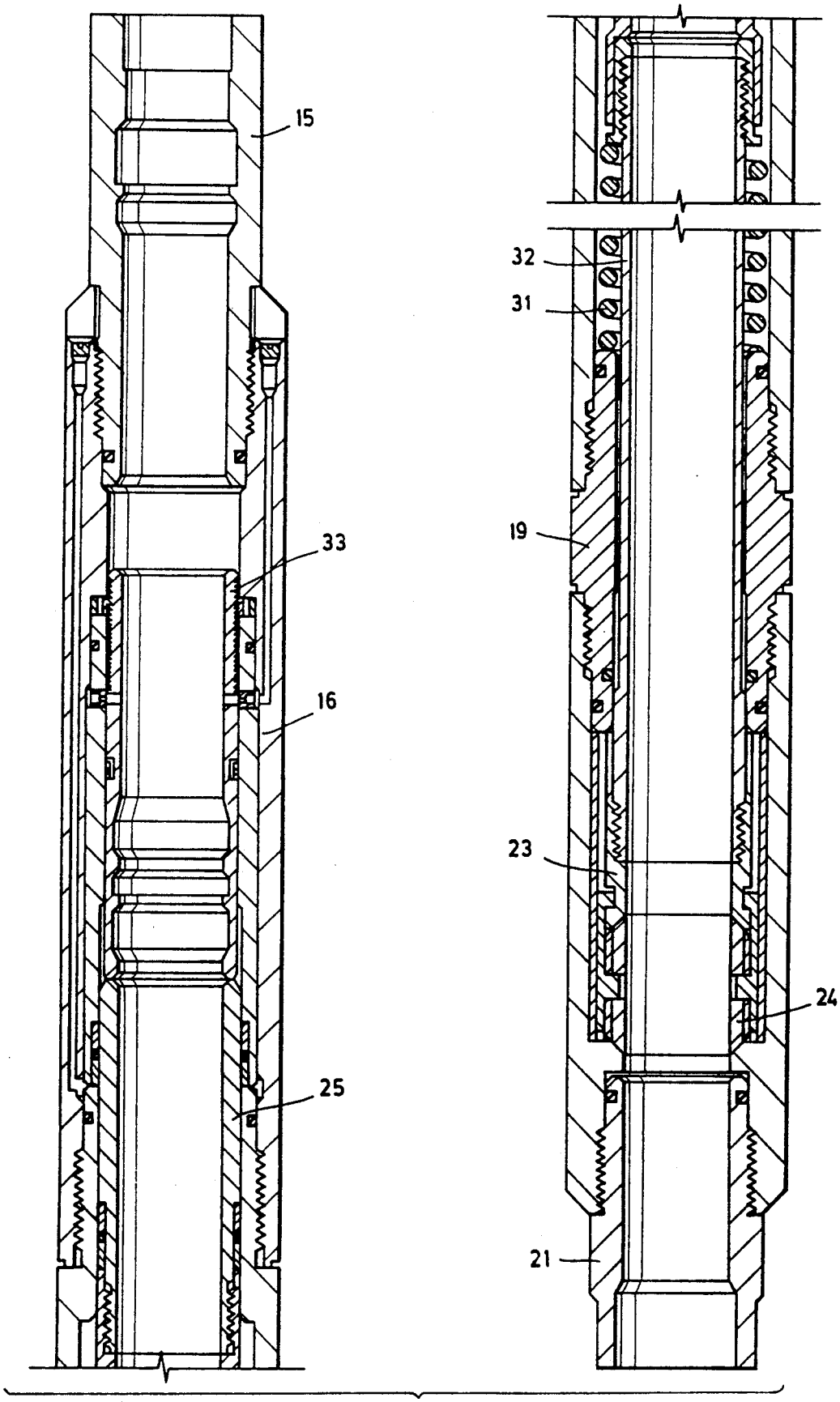
FIG. 2 is a view similar to FIG. 1 showing the valve in open position.

Referring first to the valve shown FIG. 1 and 2 the valve includes a body made up of the upper sub 15, a latch housing 16 depending from the upper sub, a spring housing 17 depending from the latch housing, a valve body 18 connected to the spring housing by a connector sub 19 and a lower sub connected to the bottom of the valve body. The body has a flowway 22 extending therethrough.

Controlling flow through the flowway is a valve seat 23 and cooperable rotatable ball valve member 24. As shown it is preferred that the valve and seat be of the traveling type but the valve may be designed to utilized a non traveling seat and ball as will be understood by those skilled in the art.

Means are provided for rotating the ball valve member 24 between its open and closed positions. This means includes a pressure responsive member such as piston 25 reciprocal in the body and having a traveling sliding seal indicated generally at 26 and a sliding seal with a seal indicated generally at 27 in the body. This provides an upwardly facing pressure responsive member exposed to pressure in the control chamber 28 receiving control fluid through a passageway 29. While the scale of the drawing does not permit its illustration, the bore through the spring housing where it is engaged by the seal 26 is slightly larger than the outer diameter of the piston 25 where it engages seal 27 to provide an upwardly facing pressure responsive member exposed to pressure in the chamber 28 which will move the valve to open position in response to an increase in pressure in chamber 28.

The valve is moved to closed position as shown in FIG. 1 by a reduction in pressure in the chamber 28 which permits the closing spring 31 to expand. The spring is compressed between the upper end of the connector sub 19 and a nut 25*b* secured to the upper end of the valve actuator 32. The nut 25*b* has a telescoping connection with a piston extension 25*a* depending from piston 25. Thus as in conventional designs the spring 31 urges the piston 25 upwardly with a continuous force to move the valve member to the closed position shown in FIG. 1 when the control pressure is reduced in chamber 28. The valve is conventionally opened by increasing the control pressure in chamber 28 to move the piston and valve actuator 32 against the force exerted by spring 31 and rotate the valve member to the open position shown in FIG. 2.

While not forming any part of this invention, the valve may be provided with a conventional lock open sleeve 33 which is moved downwardly by a tool engaging the internal lock profile 30 in the sleeve and moving the sleeve and pressure responsive member 25 downwardly to the valve open position. The sleeve 33 cooperates with a conventional latch ring 34 which permits downward movement of the sleeve while preventing upward movement of the sleeve to thus latch the lock sleeve 34 in down position. In moving downwardly the sleeve shears port seals 35 to expose the flowway to pressure within the passageway 36. Then if desired a valve may be landed in the internal lock profile 37 in the upper sub 25 and sealed with the flowway 22 above and below the plugs 35 to provide for control of the auxiliary valve in the conventional manner.

The traveling valve seat 23 is carried on the lower end of the actuator 32 and reciprocates therewith. The ball valve member 24 is carried on the valve seat 23 by opposed control arms 38 and 38*a* having confronting opposed bosses 39 and 39*a* which project into holes 41 and 41*a* in the ball valve member 24 to provide an axis for rotation thereof and to position the valve member relative to the seat with a few thousandths clearance there between. Thus with reciprocation of the piston 25, the valve seat and its attached valve member 24 are reciprocated in the valve body 18.

Disk means 40 and 40*a* are mounted for rotation about a common axis with the ball valve member. For this purpose the disk have central holes 42 and 42*a* which receive the bosses 39 and 39*a* on the control arms indicated generally at 38 and 38*a*. The disks are positioned between the control arms and the valve member 24 and reciprocate with the valve seat and valve member.

Within the body, there are positioned opposed control frames 43 and 43*a*. These control frames are fixed in position against movement both axially of the flowway 22 and against rotation within the valve body. They may be fixed in any desired way such as the extension 44 and 44*a* on the lower end of the control frames engaging the valve body 18 in any desired manner.

The control frames 43 and 43*a* include control bosses 45 and 45*a* which are positioned off center from the rotational axis of the valve member provided by the bosses 39 and 39*a*. These control frames also include the slideways 46 and 46*a* for the slides provided by the upstanding legs 47 and 47*a* of the T-shaped control arms 38 and 38*a*. The upper cross members 48 and 48*a* of the T-shaped control arms 38 and 38*a* are received in slots 49 and 49*a* on opposite sides of the valve seat 23. Thus the control arms reciprocate in the slots in the control frame with reciprocation of the valve seat 23.

The disk 40 and 40*a* are provided with slots 51 and 51*a* respectively which receive the fixed bosses 45 and 45*a* respectively to effect the rotation of the disk by engagement of the bosses and slots as the disk are reciprocated by movement of the valve seat 23 thus rotating the valve disk about the rotational axis of the valve member 24.

Figure 3:
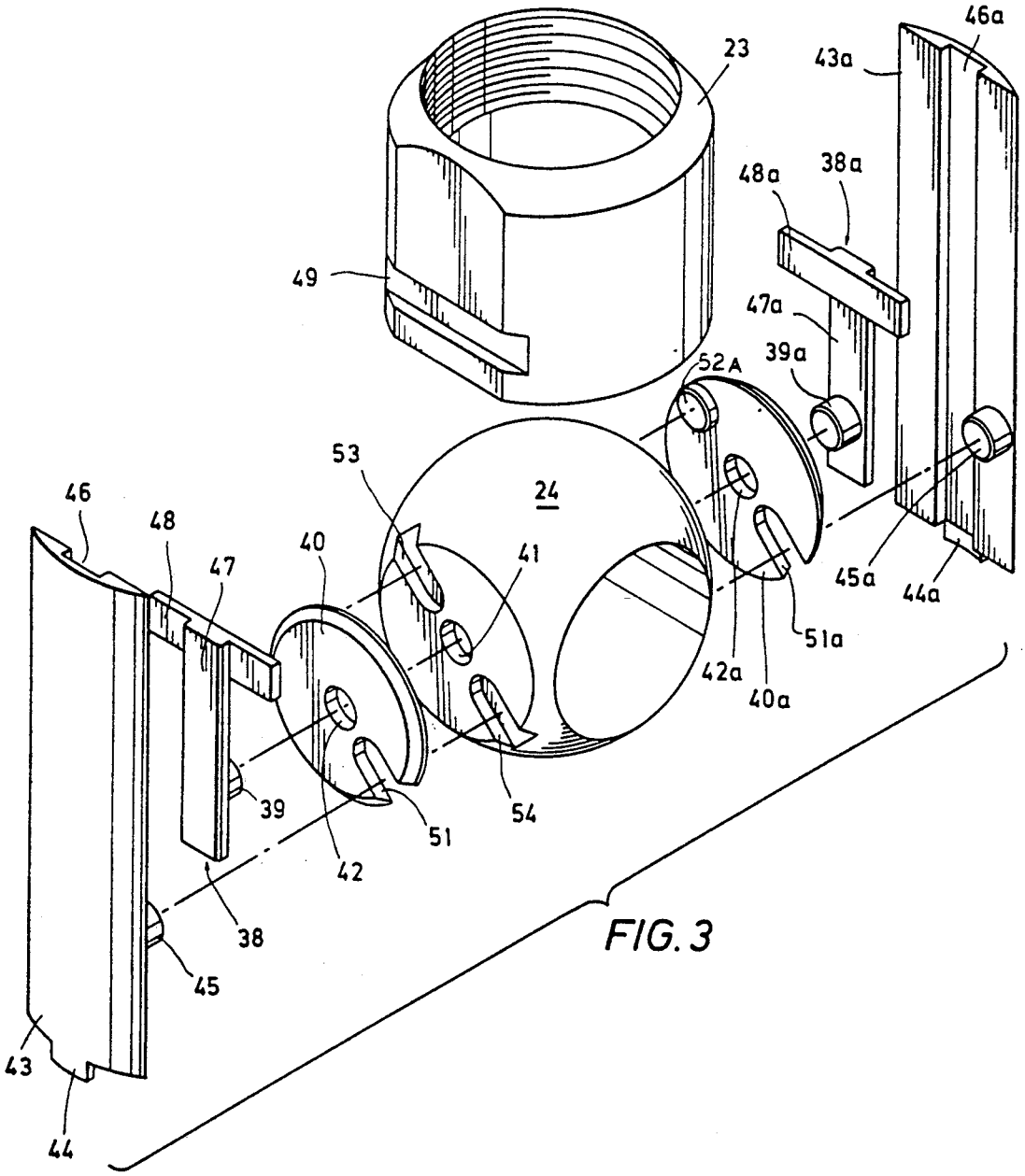
FIG. 3 is an exploded isometric view of the valve member and valve seat and its associated equipment for imparting rotation to the valve member.
Figure 4:
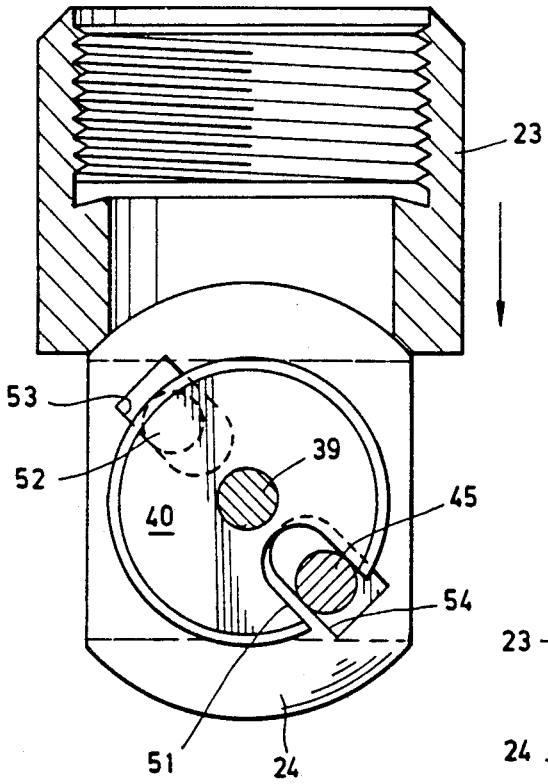
FIG. 4 is a fragmentary view of the valve seat in section and the valve member and disk in elevation together with the bosses imparting rotation showing the valve member in closed position and force being applied through the disk to move the valve member away from its seat during initial opening movement.

The valve disk are provided with bosses, one of which is shown at 52*a* on disk 40*a*.(FIG. 3) The other boss 52 on disc 40 is shown in FIG. 4.

The two opposing bosses on the two disk 40 and 40*a* project into holes in the valve member 24, one of which is provided by the slot 53 in the ball valve member. The other identical slot on the other side of the ball valve member for receiving boss 52*a* is not shown. The ball valve member is symmetrical, however, and the face of the ball valve member confronting disk 40*a* is identical to the face of the ball valve member confronting the disk 40. Thus with rotation of the disk 40 and 40*a* by engagement of the bosses 45 and 45*a* in slots 51 and 51*a* the boss 52 and its opposed boss 52*a* on the disks engage in slot 53 and its opposed slot to apply a rotational force to the ball 24.

Preferably the ball 24 as well as the discs is provided with a pair of slots for receiving the bosses 45 and 45*a*. One of these slots is shown at 54 and a comparable identical slot is provided in the opposed face of the ball 24. Thus, if desired, the closing force on the ball valve member may be applied directly by the two bosses 45 and 45*a* to the slots in the ball valve member such as slot 54 to rotate the ball valve member to closed position by direct contact between the bosses 45 and 45*a* and the slots in the ball 24.

It is preferred that the bosses 45 and 45*a* project through the disk and into the slots as exemplified by slot 54 particularly when it is desired to apply the closing force directly between the control frame bosses and the valve member. To provide a symmetrical ball valve member, the slots 53 may duplicate the slots 54 so that the ball valve member may be arranged with the slots engaging either of the bosses 45 or 52. It will be appreciated, however, that the boss 52 and its opposed boss on disk 40*a*, do not travel within the slot 53 and its companion slot and that these slots could as easily be a hole as a slot. In some designs, as will appear hereafter, it is preferred to provide a hole in the ball valve member for engagement by the boss 52 to provide a large bearing area and the slot 53 could, in the design shown in FIG. 3, be replaced by a hole. A slot is shown to illustrate one design in which the slots 53 and 54 could be identical and provide for simplicity in machining the ball.

Ball valve members are formed by cutting flats on opposite sides of a ball. The further these flats are cut from the center of the ball the less the diameter of the flats. By cutting the flats closer together and introducing discs the total bearing area available in the ball valve and disc for engagement by the fixed bosses 45 and 45*a* may be increased as the diameter of the disc may be at least as large as the diameter of the flats on ball 55. (note the relative diameter of the flats and disc in FIG.10). This increase bearing area allows more force to be applied to the ball without damage.

In the design of FIG. 3, downward movement of the seat and disk engage the fixed bosses 45 and 45*a* with slots 51 and 51*a* as illustrated in FIG. 4. This rotational force is transferred through the disk by a couple type of action to the pins 52 and 52*a* which in turn engage the hole 53 and a like hole on the other side of the ball to rotate the ball. As the force against the ball valve member exerted by the pins 52 and 52*a* is in a downward direction relative to the seat as shown in FIG. 4, this force tends to move the valve member away from its valve seat and reduce the tendency of the valve member and seat to gall due to the difference in pressure across the valve member when in its closed position.

Figure 5:
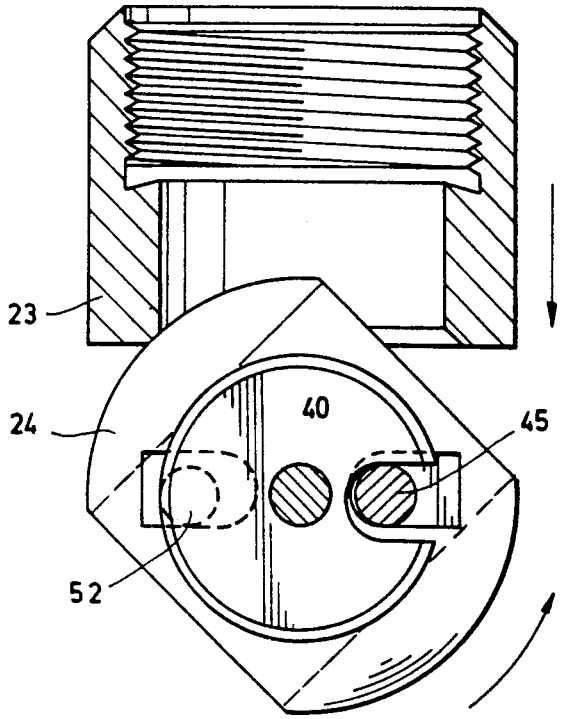
FIG. 5 is a view similar to FIG. 4 showing the ball valve member to have been partially rotated to the open position.
Figure 6:
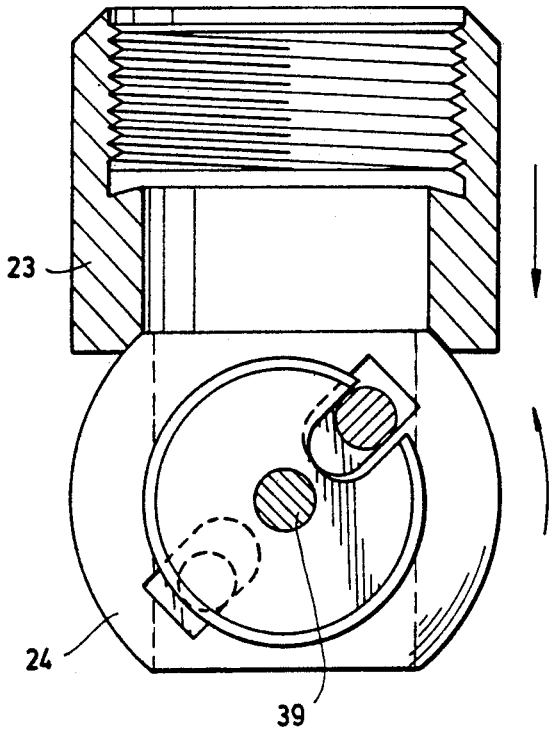
FIG. 6 is a view similar to FIG. 5 showing the ball valve member to have been fully rotated to the open position.

As best shown in FIG. 4,5 and 6, rotation of the valve member resulting from downward movement of the seat 23 is translated through the couple provided by the disk 40 and 40*a* into a downward direction on the valve member as it is rotated. This couple tends to move the valve member away from its seat and reduce the tendency of the valve member and valve seat to gall.

If desired the dimension of the slots in the disk 40 and 40*a* and ball 24 and their location may be such that while a rotational force is applied through the disk to the ball during opening action, the closing action is applied directly from the bosses 45 and 45*a* to the valve member by the fixed bosses engaging the slot 54 in the ball before engaging the slot 51 in the disc. During closing action the fixed boss 45 will engage the sidewall of slot 54 and apply direct closing force. During opening action the bosses 45 and 45*a* engage only the disk 40 and 40*a* and disk bosses in turn engage the valve member to rotate it to open position. During closing of the valve, this design provides for contact of the bosses 45 and 45*a* with the slots 54 and the companion slot on the other side of the ball to apply force directly from the control frame bosses to the valve member to rotate the valve member to fully closed position.

FIG. 7, 8 and 9 illustrate a preferred design applying a large closing force to the valve member such as possible with a design of valve as shown in FIG. 10 where large closing forces are available to close the valve with equipment therein such as a wire line or tubing. In this design, the forces are applied through the disk to urge the valve member toward its seat during closing. To provide large bearing areas, the ball 55 is provided with a hole 70 to receive the boss 56 on disk 58. The tolerance between these parts may be small so that a large bearing area will result. The slot 57 in disk 58 preferably is designed such that its width permits the boss 45 to engage the slot 57 in the disk and apply the force on the ball through pin 56 in an upward direction urging the ball toward its seat. If desired, the boss 45 may have a very small clearance with the slot 59 in the ball but as it extends into the slot this clearance with the side wall permits the pin 45 to engage the slot if the resistance to rotation is high enough to cause distortion of the component parts or surfaces. If the tolerances are held this close then direct rotative force it applied to the ball from the boss 45 while continued rotation is applied to the ball from the boss 56 on the disk thus continuing to urge the ball into contact with the seat and particularly on the side of the ball to the left as viewed in FIG. 7 which will engage a line or tubing in the valve to sever same. This urging of the ball towards its seat will reduce the tendency the ball to smear the tubing or line and assist in the cutting action. Like holes and bosses are provided on the opposite side of valve member 55.

By controlling the dimensioning of the slot 59 relative to slot 57 and the position of the slot relative to a diametral plane passing through the center of rotation of the ball the design may be varied to emphasize moving the ball away from its seat during opening or move the ball towards its seat during closing In FIG.4 the slots are offset from a diametral plane through the boss 39. By making the slot 59 sufficiently wide both results may be obtained as force would only be applied through the disk. Where it is desired to apply closing force directly from the fixed boss to the ball the design such as shown in FIG. 4 would be utilized. Where it is desired to apply the closing force through the disk and possibly supplement this force by applying force to the ball, the design of FIG. 7 would be utilized. Thus the width and positioning of the slots in the ball and in the disks which cooperate with the bosses may be varied to obtain the desired result.

FIG. 10 through 13 illustrate the combination of the application of force through the disk to urge the valve member towards its seat with the preferred design for applying a large closing force to the valve member.

The housing is provided by an upper sub 61, a connector 62 depending therefrom, a spring housing 63, a valve housing 64 and a lower sub 65. A flowway 60 extends through the housing and is controlled by the valve seat 66 having the valve 55 cooperable therewith to open and close the passageway. In this design the control frame 67 and its opposed frame 67*a* are supported in a sleeve 68. The sleeve 68 may have a lower inturned flange 68*a* with slots therein to receive the aligning projections 44 and 44*a* (FIG. 3). As best shown in FIG. 13, the control arms 69 and 71 have horizontally extending cross members such as shown at 72 for engagement with the slots 73 in the valve seat 66 to reciprocate the control arms with the valve seat which in turn carry the valve member 55. It will be appreciated that any desired form of control frame and control arms could be utilized as illustrated in the two different designs shown.

Reciprocation of the valve seat 66 and the valve member 55 is accomplished by reciprocation of the actuator tube 74 which is attached to the valve seat. The actuator tube 74 is in turn reciprocated by the piston 75 in a chamber 78 in response to pressure differential thereacross.

Control fluid pressure is applied from the surface through control line 76 and conduit 77 to the chamber 78*a* and the upper side of the piston 75. Thus in normal operation, increase in pressure against the upper side of piston 75 results in downward movement of the piston to open the valve as shown in FIG. 11 and a reduction in this pressure results in upward movement of the piston to the valve closing position shown in FIG. 10.

The force for moving the valve to closed position shown in FIG. 10 is applied by the closing spring 80 and by gas pressure within the chamber or pressure dome 78 which includes the lower surface of the piston 75.

In accordance with this invention the chamber 78 provides a spring chamber and also provides the pressure dome thus eliminating the need for extra pistons and extra seals present in prior designs. This pressure dome is also a means for applying balance pressure to the piston 75 as well as a means for applying a closing force to the piston by increasing the pressure within the pressure dome 78.

To accomplish the above objective, a balance or assist pressure line 79 communicates with a conduit 81 in the connector 62, which in turn connects with a conduit 82 in the spring housing 63. The conduit 82 opens into the lower end of the pressure dome 78.

A float valve indicated generally at 83 controls the flow of fluid between the conduit 82 and the pressure dome 78. The float valve 83 includes a seat 84 which connects with the conduit 82 and a float valve member indicated generally at 85.(FIG.12) This member includes an exterior valve member 86 having an internal bore therein which is filled with a light float material 87 such that the float valve member 85 will be buoyant in the liquid in line 82 but is nonbuoyant in the gas within the pressure dome 78.

Preferably a separate charge port is provided by a conduit 88 and a transverse charge port 89 at the lower end thereof to permit a charge of gas to be introduced into the pressure dome 78. By charging the dome with the valve in the upright position the float valve member 85 will be positioned on its seat and held in place by the charge of pressure within the dome during transporting and running of the valve. The balance fluid conduit 79 will be filled with liquid and the gas charge in chamber 78 will reflect the pressure exerted by the hydrostatic head of balance fluid. This pressure will substantially balance the hydrostatic pressure in control line 76. A substantial advantage obtains in that as the piston 75 reciprocates the gas may expand and contract and it is not necessary to move a substantial volume of the balance liquid through the valve 87. The pressure dome area being large, that is including the entire spring chamber, the percentage change in volume of the pressure dome is relatively small between open and closed positions as compared to pressure domes in prior valves. This plus the lack of a need to move a substantial volume of balance liquid through the conduit 82 gives a substantially superior design.

Further, when additional force is needed to cut through a wire line or a tubing in the valve 55, pressure may be increased in the balance line 79 to force liquid into the pressure dome 78 thus increasing the pressure within the dome to exert the desired force to cut the wire line or tubing. Thereafter the pressure within the balance line may be reduced and the liquid will be forced from the pressure dome 78. If the valve seat 84 is above the liquid level the valve member 85 seats and retains the dome charge after the valve has cut through a wire line or tubing.

The valve may be designed for injection of fluids such as chemical injection and this is illustrated in FIG. 10. By removing the plug 91 and plugging the lower end of the conduit 77 at 92, the passageway 77 is connected to the passageway 93 which opens to the bottom of the valve below the valve member 55. As will be understood by those skilled in the art this illustrates how a third passage may extend down through the valve and provide for chemical injection by-passing the valve member.

The foregoing disclosure and description of the invention is illustrative and explanatory thereof and various changes in the size, shape and the materials, as well as in the details of the illustrated construction may be made within the scope of the appended claims without departing from the spirit of the invention.

What is claimed is:

1. A valve comprising:

a body having a flowway therethrough;

a valve seat and cooperable valve member controlling flow through said passageway; and means for moving said valve member between open and closed positions comprising:

a chamber having a piston slidable therein, said chamber above said piston providing a control chamber having a port for receiving control fluid, said chamber below said piston providing a dome chamber, said piston sealing between said control and dome chambers a port opening into the bottom of said dome chamber, a charge of gas in said dome chamber, and a float valve and seat positioned in the bottom of said dome chamber and controlling said dome chamber port, whereby said gas may be introduced through said port driving any liquid in said port into said dome chamber to increase the pressure therein and said gas will be trapped in said dome chamber when said liquid in said dome chamber drops to a predetermined level and permitting said float valve to seat against said float valve seat to assist in closing said valve member.

2. The valve of claim 1 wherein a closing spring is positioned in said dome chamber and urges said piston toward closed position, and a charge of gas under pressure in said dome chamber urges said piston toward closed position.

3. The valve of claim 1 or 2 wherein a separate charging port is provided in said dome chamber.

4. A valve comprising:

a body having a flowway therethrough, valve means controlling said flowway, a fluid chamber in said body, piston means dividing said chamber into a control fluid chamber and a pressure dome and sealing therebetween, said piston means connected to and moving said valve means between open and closed positions with reciprocation of said piston means, a charge of gas under pressure in said dome urging said piston means toward valve closing position, an inlet into the bottom of said pressure dome, a liquid float check valve and seat positioned in the bottom of said dome chamber and controlling said inlet, whereby said gas may be introduced through said inlet driving any liquid in said inlet into said dome chamber to increase the pressure therein and said gas will be trapped in said dome chamber when said liquid in said dome chamber drops to a predetermined level and permitting said float valve to seat against said float valve seat to assist in closing said valve member.

5. The valve of claim 4 wherein spring means in said pressure dome urges said piston toward valve closing position.

6. The valve of claim 4 or 5 wherein a separate charge port is provided for charging a gas under pressure into said pressure dome.

7. The valve of claim 1, 2, 4, or 5 wherein;

disc means is rotatable about a common axis with said ball valve member, means including first boss means on one of said body and disc means and first hole means in the other of said body and disc means is provided for rotating said disc means,and means including second boss means on one of said disc means and ball valve member is cooperable with second hole means in the other of said disc means and ball valve member for rotating said ball valve member in response to rotation of said disc means.

8. The valve of claim 1, 2, 4 or 5 wherein;

said seat and valve member travel between open and closed positions, disc means is carried by the valve seat and is rotatable about a common axis with said valve member, first boss means in said body extends into off-center slot means in said disc means to effect rotation of said disc means with travel of said valve seat, and second boss means is carried by said disc means and engages off-center holes in said valve member and rotates said valve member with travel of said valve seat.

9. The valve of claim 1, 2, 4 or 5 wherein;

said seat and valve member travel between open and closed positions, opposed control frames in said body have opposed slideways and opposed fixed bosses, opposed control arms are carried by said seat and have slides positioned in said slideways and opposed bosses supporting said valve member for rotation, disc means between the valve member and each control arm is rotatable about said control arm bosses, each disc means has a slot receiving one of said fixed bosses, and each disc means has a boss projecting into a hole in said valve member.

* * * * *